United States Patent [19]

Hardesty

[11] 4,448,472

[45] May 15, 1984

[54] SLOTTED, SUBSTANTIALLY RIGID MULTI-CONDUCTOR ELECTRICAL CONNECTOR

[75] Inventor: Edwin C. Hardesty, Perry Hall, Md.

[73] Assignee: AT&T Technologies, Inc., New York, N.Y.

[21] Appl. No.: 302,865

[22] Filed: Sep. 16, 1981

[51] Int. Cl.[3] ..... H01R 9/08

[52] U.S. Cl. ..... 339/97 P; 339/220 T

[58] Field of Search ..... 339/97 R, 97 P, 98, 339/99 R, 220 R, 220 T, 221 R, 221 M, 256 R, 258 R

[56] References Cited

U.S. PATENT DOCUMENTS

| | | | |
|---|---|---|---|
| 1,934,560 | 11/1933 | Rawlings . | |
| 2,651,768 | 9/1953 | Oortgijsen . | |
| 2,972,275 | 2/1961 | Baubles . | |
| 3,183,472 | 5/1965 | Pawl . | |
| 3,377,611 | 4/1968 | Pawl . | |
| 3,425,311 | 2/1969 | Levy . | |
| 3,557,402 | 1/1971 | Koehl . | |
| 3,579,178 | 5/1971 | Travis | 339/221 R |
| 3,634,818 | 1/1972 | Horecky | 339/256 R X |
| 3,845,455 | 10/1974 | Shoemaker | 339/97 |
| 3,877,773 | 4/1975 | Doty et al. | 339/97 P |
| 3,897,128 | 7/1975 | Reavis, Jr. | 339/98 |
| 3,960,318 | 1/1975 | Reavis, Jr. et al. | 339/99 |
| 4,011,647 | 3/1977 | Peterson | 29/750 |
| 4,033,661 | 7/1977 | Moody | 339/98 |
| 4,049,334 | 9/1977 | Siden | 339/97 R |
| 4,103,984 | 8/1978 | Mixon | 339/98 |
| 4,116,522 | 9/1978 | Reynolds | 339/97 R |
| 4,130,331 | 12/1978 | Neff et al. | 339/97 R |
| 4,133,596 | 1/1979 | Dauser, Jr. | 339/98 |
| 4,141,618 | 2/1979 | Reavis, Jr. et al. | 339/97 P |
| 4,192,570 | 3/1980 | Van Horn | 339/98 |
| 4,194,802 | 3/1980 | Spaulding | 339/97 P |
| 4,210,378 | 7/1980 | Baribeau | 339/97 R |
| 4,291,935 | 9/1981 | Badoz et al. | 339/97 R |

FOREIGN PATENT DOCUMENTS

| | | | |
|---|---|---|---|
| 1136738 | 5/1957 | France | 339/97 R |
| 615737 | 1/1949 | United Kingdom . | |
| 637004 | 5/1950 | United Kingdom . | |

OTHER PUBLICATIONS

"QCP: The Latest Frame Wiring Method for Telcos'-'-*Telephony*, in Nov. 15, 1982 issue.

"Telco Terminals–The Search Goes On", Telephone Engineer and Management, Apr. 15, 1983, Beginning at p. 76, Brochure–AMP–Barrel Terminals.

Brochure–"QCP—The Circuit Concentration System for Tomorrow's World of Communications".

Brochure–"QTB TM —Quick Connect Terminal Blocks", Published by ADC–Magnetic Controls Company.

Brochure–"Q66 Connecting Blocks", Published by ADC–Magnetic Controls Company.

Brochure–ADC–"Quick Connect Panel (QCP)", Published by Magnetic Controls Company.

*Primary Examiner*—Mark Rosenbaum
*Assistant Examiner*—Timothy V. Eley
*Attorney, Agent, or Firm*—E. W. Somers

[57] ABSTRACT

A contact element for establishing an electrical connection between two insulated conductors includes a tubular member having at least one open end and being made of an electrically conductive material. The tubular member includes surfaces that define a slot which extends from the open end and which has a width that is less than the diameter of the conductive elements of the insulated conductors. The tubular member has sufficient stiffness and the slot is configured to cause at least portions of the surfaces that define the slot to nick the conductive element of each of one or more conductors that are moved into and along the slot. Any deflection of the slot surfaces which accompanies the movement of one or more insulated conductors into the slot is substantially negligible. In one embodiment, a portion of the periphery of the tubular member at its open end is coined so that as an insulated conductor is moved into the slot, any portion of it which overhangs the wall is severed by the coined portion; in another, the periphery includes an opening to allow the conductor to extend therethrough.

10 Claims, 20 Drawing Figures

SLOTTED, SUBSTANTIALLY RIGID MULTI-CONDUCTOR ELECTRICAL CONNECTOR

TECHNICAL FIELD

This invention relates to a slotted, substantially rigid contact element for an electrical connector system. More particularly, it relates to a solderless, tubular contact element having a slot in which one or more conductive elements are received and nicked and having sufficient stiffness so that any deflection caused by the conductive elements in the slot is substantially negligible.

BACKGROUND OF THE INVENTION

Prior art connectors which are currently in wide use for splicing and for connecting insulated conductors in telephone and other electrical circuits generally include a plurality of contact elements which are mounted in terminal blocks. The contact element must be such that it provides a reliable connection which is easily made and such that it is relatively small to minimize space requirements.

Electrical connections for telecommunications have been made in a number of ways. One of these is by way of terminals which include a post and nut arrangement. In those, an end of an insulated conductor is bared and wrapped about a threaded post with a nut being turned along the post to engage the conductor end and to hold it in engagement with a terminal block from which the post extends. Typically, an opposite end of the post is formed to have another conductor wrapped thereabout. While this arrangement results in a reliable connection, it is labor intensive and escalates costs.

Another connection arrangement includes an element which when inserted into a dielectric housing is caused to pierce an insulated conductor and establish electrical engagement therewith. An example of this kind of arrangement is the familiar modular plug in which blade-like terminals are seated in a housing such that tangs of the terminals pierce tinsel conductors and make electrical contact therewith. See for example U.S. Pat. No. 3,860,316 which issued to E. C. Hardesty on Jan. 16, 1975. One problem with these kinds of connectors lies in their relative inability to pierce solid conductors as opposed to stranded or tinsel conductors. Desirably, a connector for use in a multiconductor system is adaptable to interconnect solid as well as stranded conductors.

A connector which is widely used in telecommunications for interconnecting insulated conductors in which the conductive elements are solid is one which is called a split beam connector. A plurality of metallic contact elements are mounted in a dielectric housing. Each of the contact elements, in one well-known product, includes a center portion with beams extending colinearly therefrom. Each of the beams is bifurcated with the furcations of each forming a conductor-receiving slot. To establish a connection, an insulated conductor is moved into one slot and another conductor into the opposite slot. Surfaces that define the entrances to the slots and the slots themselves are configured to nick the conductive element of each conductor to establish an electrical connection between the conductors. See for example U.S. Pat. No. 3,496,522 which issued on Feb. 17, 1970 in the names of B. C. Ellis et al and U.S. Pat. Nos. 3,611,264 and 3,772,635.

While the split beam connector just described overcomes problems associated with the terminal post and piercing type connectors, it presents other problems. For example, special features must be included to insure continuing connections between the furcations and the conductors notwithstanding changes to the outer diameter of the insulated conductor which are caused by temperature cycling. Another problem with the split beam connector relates to its capability of using one slot to terminate two or more conductors or conductors of different gauges. When the insulated conductor first placed in the slot is moved farther inwardly, it tends to spread apart the side walls of the furcations which define the slot and which in prior art connectors are generally resilient. Disadvantageously, the surfaces which define the slot can be deflected to an extent that precludes the establishment of a satisfactory gas-tight connection with the conductive element of a second conductor that is moved into the slot.

Also, the conventional split beam connector does not provide an altogether effective connective mechanism for stranded conductors. When a stranded conductor is moved into the slot, the furcations which are resilient are deflected. The configuration of the conductor is deformed and the individual strand elements become rearranged in the slot with some diminution of the nicking of the elements.

While the prior art abounds with connectors for insulated conductors, it does not include one which overcomes the problems which have been discussed hereinbefore. For example, in U.S. Pat. No. 4,033,661, walls of an insulating body define an aperture extending transversely of and intersecting each of two stacked conductor-receiving channels. A cylindrical contact element includes one slot designed to make electrical contact with a conductor in one of the two channels and a second slot to electrically engage a conductor which is disposed in the other channel. Barrel type terminals which are shown in U.S. Pat. Nos. 3,860,318, 3,877,773 and 3,845,455 are rolled from sheet material and have walls which are sprung apart by inserted conductors. Should more than one conductor be moved into a slot, the spring characteristic of the walls favors the largest one. To overcome this, slots are formed transverse of the longitudinal slot to facilitate the movement of a conductor from one longitudinal slot to the other. However, in this arrangement, each portion of each slot can only establish a connection with one conductor. W. S. Pawl in his U.S. Pat. No. 3,377,611 discloses a solderless, rigid electrical connector of a thickness which is substantially greater than the diameter of a wire to be received in a parallel sided slot. As a result, the conductive element of a conductor is compressed as it is forced into the slot to maintain suitable contact.

What is needed for use in a multi-conductor connection system and what the prior art does not provide is a contact element which is capable of establishing and maintaining a suitable electrical connection with stranded, tinsel or solid wire-like conductors. Further, it should be able to establish and maintain electrical engagement with one or more conductors of the same or different gauge size in the same slot. With today's seemingly endless growth of telecommunications, there is still a need for an electrical connector that is relatively small and that fills the above needs.

SUMMARY OF THE INVENTION

The foregoing needs of interconnection are met by the contact element of this invention having an open-ended tubular portion at least at one end thereof to electrically connect conductors. The tubular portion is made of an electrically conductive material and includes surfaces that define a longitudinally extending conductor-receiving slot which extends from the open end. The slot includes an entry portion at the open end of the tubular portion and a conductor-retention portion which communicates with the entry portion. The slot is configured and the tubular member has sufficient stiffness to cause at least portions of said surfaces to nick each of one or more conductors that are moved into and along the slot. Any deflection of those surfaces which is caused by one or more conductors being moved into the slot is substantially negligible. In a preferred embodiment which is used to interconnect two insulated conductors, the material of the tubular portion has a relatively high modulus of elasticity. Also, the width of the conductor-retention portion is less than the diameter of the conductive elements of the insulated conductors.

In the use of the contact element of this invention, an insulated conductor is positioned across the end of the slotted tubular portion so that it is aligned with the slot. Forces are applied to the conductor to cause it to be moved into the slot with the edges of the wall establishing electrical contact with the conductive element of the conductor. Advantageously, the insulation need not be removed from an end of the conductor that is terminated with the contact element of this invention. In one embodiment, a portion of the periphery of the tubular portion is beveled to cause the conductor end to be severed as the conductor is moved into the slot.

Another advantage of the contact element of this invention is its capability of establishing electrical engagement with more than one conductor. This is accomplished by making the contact element of a material and with a wall thickness and other dimensions to cause its stiffness to be relatively high. For a parallel sided slot, there is no diminution of electrical contact when a second wire-like conductor is moved into a slot in which a first conductor is already positioned. This advantage over prior art connectors is also realized with a tapered slot. Where a first-entered conductor is moved from its initial position, where it had been nicked, to a position farther into a tapered slot by the next conductor, it becomes further nicked, by scoring, shearing or gouging, to generate increased pressure between the conductor and the walls of the slot.

The contact element of this invention includes a substantially stable conductor-receiving slot. This is provided with a roll or spring pin type tubular contact element, for example, having an inner diameter that is only slightly greater than the outer diameter of a conductor to be terminated therewith, and a relatively large wall thickness. Also, the hardness of the material comprising the contact element is substantially greater than that of the conductor to be received in the slot. The contact element is effective to provide a high pressure, low resistance effectively gas-tight connection with an insulated conductor.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 3:
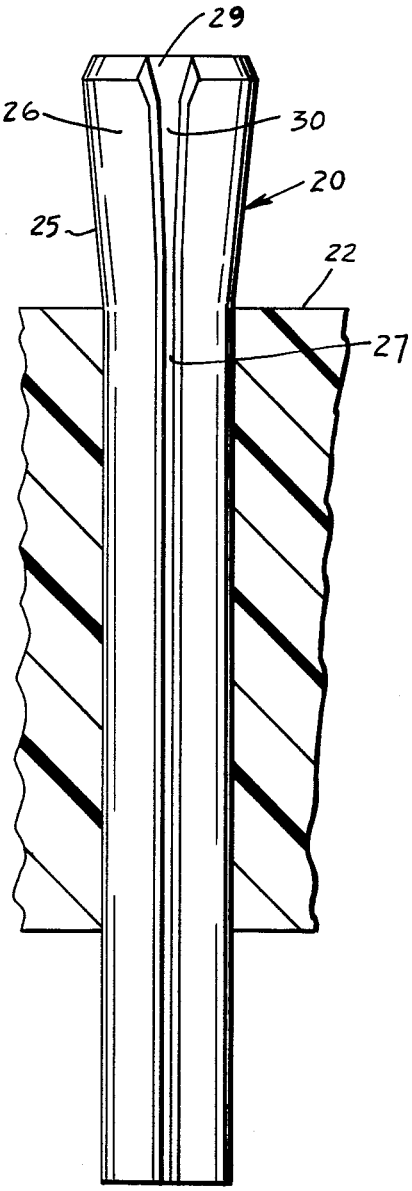
FIG. 3 is a side elevational view of the contact element mounted in a dielectric block.
Figure 1:
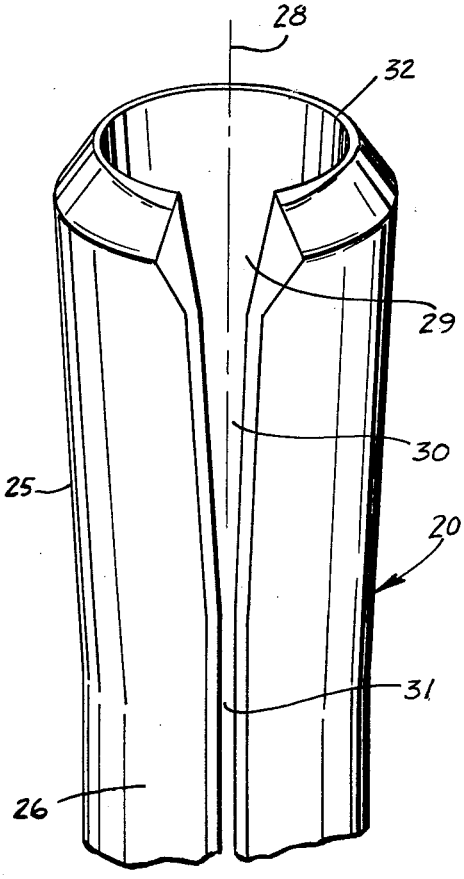
FIG. 1 is a perspective view of the contact element of this invention.
Figure 2:
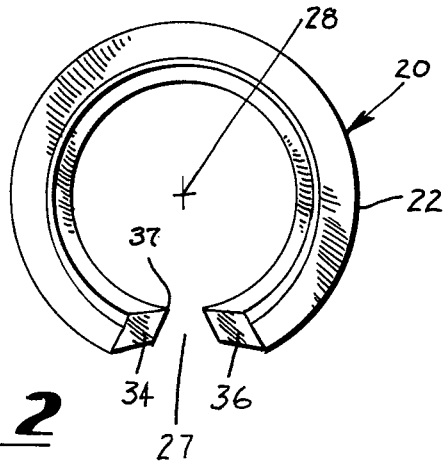
FIG. 2 is an enlarged end view of the contact element of FIG. 1.
Figure 9:
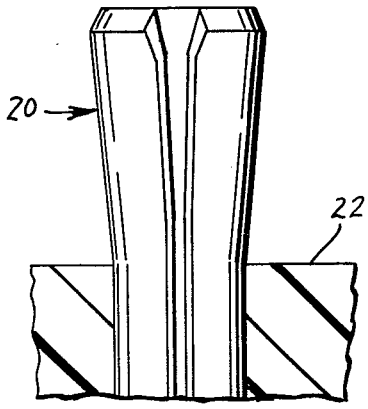
FIGS. 9–11 are a sequence of views to show the termination of two insulated conductors with the contact element of this invention.
Figure 4:
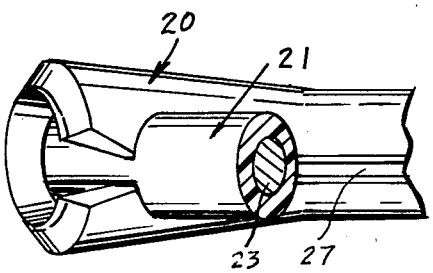
FIG. 4 is a perspective view of an insulated conductor received in the slot of the contact element.

Referring now to FIGS. 1–3, there is shown a contact element 20 of this invention for connecting electrically two or more conductive elements. In order to provide an interconnection for a plurality of insulated conductors 21—21 (see FIGS. 4–5) such as, for example, in a communications cable splice, it is expected that a plurality of the contact elements would be mounted in a support block 22 which is made of a dielectric material. Each insulated conductor 21 includes a conductive element 23 and an insulative cover 24.

The contact element 20 includes an open-ended tubular member 26 which is made from a relatively hard material such as, for example, spring steel, Phosphor bronze, beryllium-copper, or hard brass. In a preferred embodiment, the tubular member 26 is formed to include a tapered or flared portion 25 (see FIGS. 1 and 2) and has a wall thickness which is substantially less than the diameter of the conductive element 23 of an insulated conductor 21 to be terminated by the contact element 20. Typically, the tubular member 26 has an outer diameter which tapers from about 0.072 to about 0.065 inch and a wall thickness of about 0.014 inch.

In order to provide particular connection characteristics, the tubular member 26 is designed to have a relatively high stiffness. This is provided by the tubular member 26 which has a relatively small inner diameter "$d_i$" (see FIG. 5) and a relatively large wall thickness "t". This configuration of a tubular member which is available commercially is referred to as a roll or spring pin and is used, for example, to pin gears on shafts. See for example U.S. Pat. No. 3,425,311. Since its stiffness is also a function of the modulus of elasticity of the material of which it is made as well as of its structural configuration, the tubular member 26 is made of materials having a relatively high modulus, such as, for example those specified hereinabove.

In order to receive and to retain insulated conductors, the tubular member 26 includes a longitudinally extending slot 27 which is parallel to a centerline 28 of the tubular member. The slot 27 is referred to as a conductor-receiving slot and in a preferred embodiment includes an entry portion 29 and a tapered portion 30 that communicates with an inner portion 31. The entry portion 29 is configured to facilitate the movement of an insulated conductor into the portion 31. As such, it is flared with a relatively wide mouth that transitions into the tapered portion 30. Although the inner end of the tapered portion 30 of the slot 27 is shown in FIG. 3 to coincide generally with an outer surface of the dielectric block 22, it could just as well extend into the block or be spaced above it.

The slot portions 30 and 31 generally have a width which is less than the diameter, Dw (see FIG. 5), of the conductive element 23 of the insulated conductor 21. In one embodiment, the entry portion 29 has a width of 0.042 inch at its outer end and about 0.020 inch at its inner end and a length of about 0.025 inch. From the 0.020 inch width, the tapered portion 30 which has a length of about 0.100 inch decreases to 0.010 inch at its junction with the inner portion 31. Typically, the contact element 20 of this invention which has a length of about 0.63 inch is destined to terminate 22 to 26 gauge insulated conductors which have conductive element diameters of 0.025 and 0.016 inch, respectively.

Figure 6:
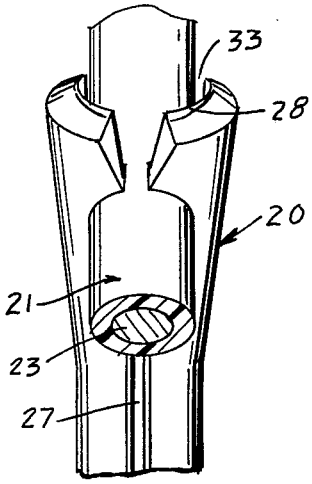
FIG. 6 is a perspective view of an alternative embodiment of this invention.
Figure 7:
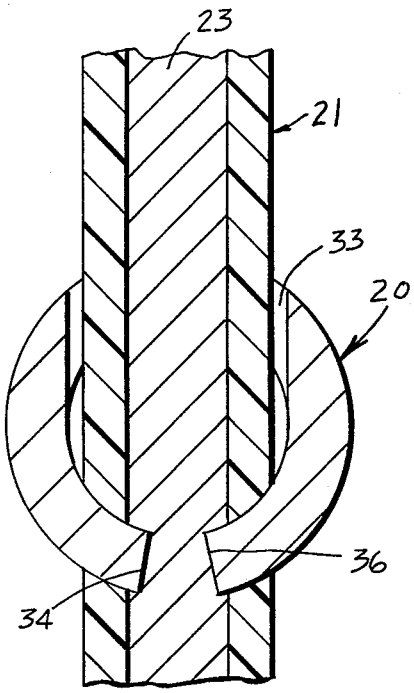
FIG. 7 is an end view of the alternative embodiment of FIG. 6.

A portion of the tubular member 26 which is opposite to the entrance 29 is beveled. In a preferred embodiment, the beveled portion is coined or otherwise formed to provide a thin or relatively sharp edge 32 at a portion of the periphery opposite to the slot 27. When a conductor 21 is moved into the slot 27 of the contact element 20 shown in FIGS. 1–5, it is severed by the coined portion 32. There may be instances where conductor cutoff is not desired. For those applications, the tubular member 26 is formed with an opening 33 in the rear wall opposite to the slot 27 (see FIGS. 6–7).

Figure 8:
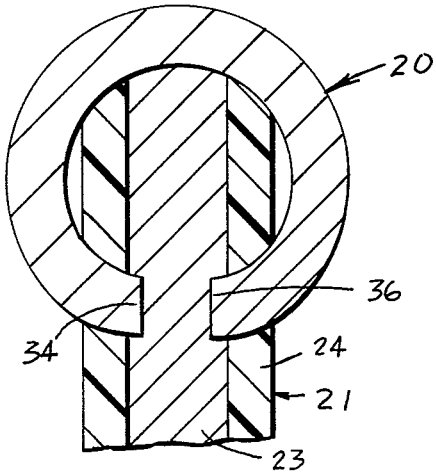
FIG. 8 is an end view of an alternative embodiment of surfaces which form the conductor-receiving slot.

Walls or surfaces 34 and 36 (see FIG. 2) which define the slot 27 are formed in a particular manner which enhances the electrical engagement with the insulated conductors 21—21. In a preferred embodiment, the slot 27 is formed so that the walls 34 and 36 extend generally radially from the centerline 28 of the tubular member 26 (see FIGS. 1–2 and 5). In an alternative embodiment shown in FIG. 8, the walls which define the slot 27 are parallel.

When a conductive element is moved into the slot 27 of the contact element 20, the stiffness of the tubular member 26 prevents any deflection of the surfaces 34 and 36 except that which is substantially negligible. As an insulated conductor 21 is moved into the slot 27, edges 37 and 38 as well as the edges 41 and 42 of the walls 34 and 36, respectively, experience substantially negligible deflection and slice through the insulation 24 and become embedded in the conductive element 23 of the conductor 21. Any weakening of the conductive element 23 is offset by suitable strain relief provisions. The electrical engagement is caused to occur as a result of the slot walls 34 and 36 nicking the conductive element. This is unlike some prior art connection systems in which the conductors are deformed, other than by nicking, and reconfigured as they are moved into the slot and are connected electrically to the slot walls by a compressive engagement therewith.

Figure 5:
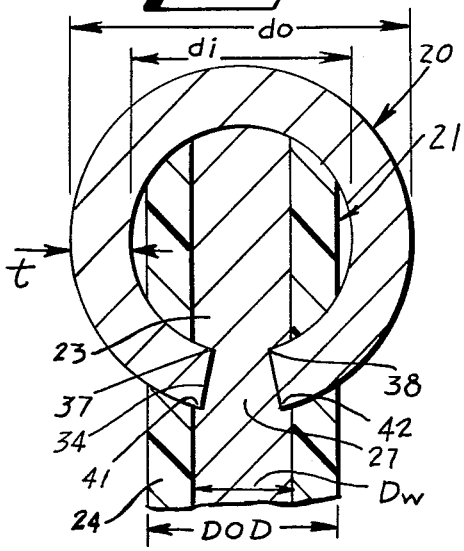
FIG. 5 is an end view of a first insulated conductor received in a portion of a slot of the contact element of FIG. 1.
Figure 10:
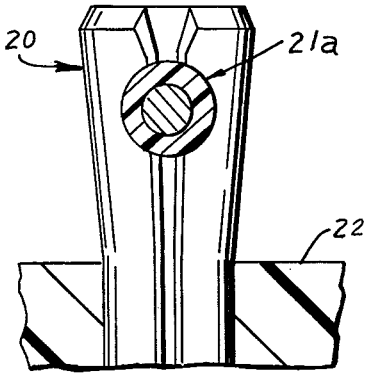
Figure 11:
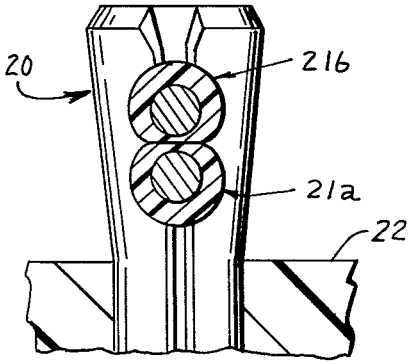
Figure 12:
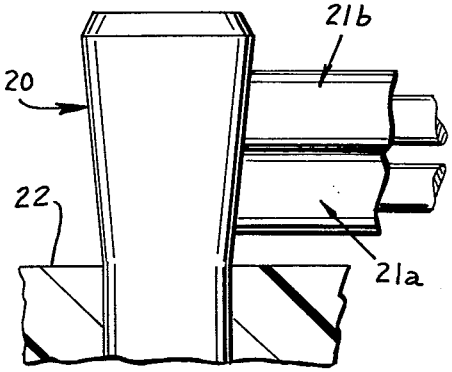
FIG. 12 is a side elevational view showing two conductors within a slot of the contact element.

Nicking of the conductive element 23 of the conductor 21 is assured in the embodiment shown in FIG. 5. However, where the walls 34 and 36 are parallel, the contact element 20 may require further definition to achieve a nicked engagement rather than the prior art compressive engagement of the conductive element 23. This is accomplished with a contact element 20 in which the thickness of the tubular member 26 is substantially less than the diameter, Dw, of a wire-like conductive element which is moved into the slot 27.

These important connection characteristics of substantially negligible deflection and nicking are achieved while maintaining a relatively small size of the tubular member 26. Not only is the thickness "t" of the tubular member 26 less than the diameter Dw of the conductive element 23, but also the DOD of the insulated conductor 21 of the expected range is between 0.045 and 0.029 inch. The $d_i$ of the tubular member varies from about 0.044 to 0.037 inch. This results in an extremely high density of the contact elements 20—20 per unit area.

In the use of the contact element 20 of this invention in a splicing system, for example, it may become necessary for more than one conductor 21 to be received in the slot 27. One of the desired features of a contact element is that it is capable of being used to interconnect conductors of different gauge sizes as well as pairs of conductors of the same gauge which fall in a predetermined range. As will be recalled, this presents a problem in prior art bifurcated beam contact elements having relatively resilient furcations which are deflected by a first inserted conductor and then further deflected as the first inserted conductor is moved farther into the slot by a second conductor.

The problem of terminating more than one conductive element in the same slot 27 is overcome with the contact element 20 having dimensions and being made of a material so that the walls 34 and 36 which define the slot 27 are substantially unyielding. The stiffness of the contact element 20 is such that when a conductor or conductors are moved into the slot 27 the deflection of the surfaces that define the slot is substantially negligible. As a result, the contact element 20 of this invention has a substantially stable slot configuration.

In the contact element 20 of this invention, this capability is also provided by forming the slot 27 so that the portions of its walls which engage the conductor are spaced apart to nick the conductive element of each conductor. The conductor-receiving slot 27 is sized so that the walls 34 and 36 which define the slot displace material from each side of each conductor 21 that is moved into the slot. It is not uncommon for the conductive element of the conductor 21 to be nicked about 10 or 15% of its diameter on each side for a total displacement of about 25%. This amount of nicking guarantees a gas-tight connection. The spacing is such that there is sufficient nicking of the smallest expected conductor to establish a suitable electrical connection and such that the nicking of the largest expected conductor will not unduly weaken its cross-section.

Another advantage of the contact element 20 insofar as multiconductor termination is concerned is realized by forming the slot 27 in the preferred embodiment of this invention so that it tapers inwardly (see FIGS. 1 and 2) from the open end of the tubular member 26. When a first conductor 21*a* is moved further into the slot 27 by the introduction of a second conductor 21*b* (see FIGS. 9–12), the first conductor undergoes a slight increase in the amount of nicking instead of causing the walls to yield. Consequently, the second conductor which is introduced into the slot merely replaces the first in its initial position and is caused to have the desired minimum amount of nicking. As for the first, its movement farther into the slot 27 improves and guarantees the gas-tight connection between it and the walls 34 and 36. Unlike some prior art contact elements, the contact element of this invention maintains suitable electrical engagement with a conductive element of an insulated conductor notwithstanding exposure to severe temperature cycling.

The amount of nicking must be controlled not only as to its minimum value but also as to its maximum. While a minimum amount of nicking is required in order to establish sufficient electrical engagement of the conductors, there is also a maximum amount which must not be exceeded. If the maximum value was exceeded, the strength of the conductor 21 may be unduly impaired which could lead to deconnection at some future time. Control of the amount of nicking is much easier when the walls which define the conductive element receiving slot are substantially non-deflecting as here.

This problem is overcome in one embodiment of the invention in which the edges 37 and 38 in the embodiment shown in FIG. 5 are spaced apart a distance which does not provide excessive nicking. Because the walls 34 and 36 which define the slot 27 are directed in a radial direction as can be seen in FIG. 5, their edges 33 and 34 nick the conductor 21 at diametrically opposed locations. The nicking in such an arrangement is cumulative and if not controlled could impair the mechanical strength of the conductor. Of course, in an embodiment shown in FIG. 8, the distance between the parallel walls which define the slot 27 must be spaced a sufficient distance apart to prevent excessive nicking.

Figure 13:
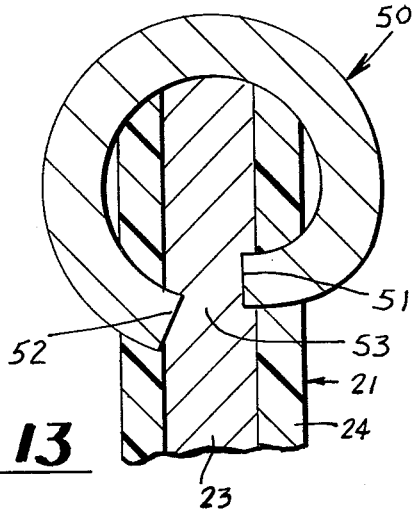
FIG. 13 is an end view of a conductor which is received in a slot of an alternative embodiment of the contact element of this invention.

This condition may be avoided by insuring that the nicking of the conductor does not occur at diametrically opposed locations. This is accomplished by the contact element 50 which is shown in FIG. 13. One of the walls 51 or 52 which define a slot 53 is turned slightly so that its associated edge which engages the conductor 21 does so at a location other than one diametrically opposed to the other edge.

Figure 14:
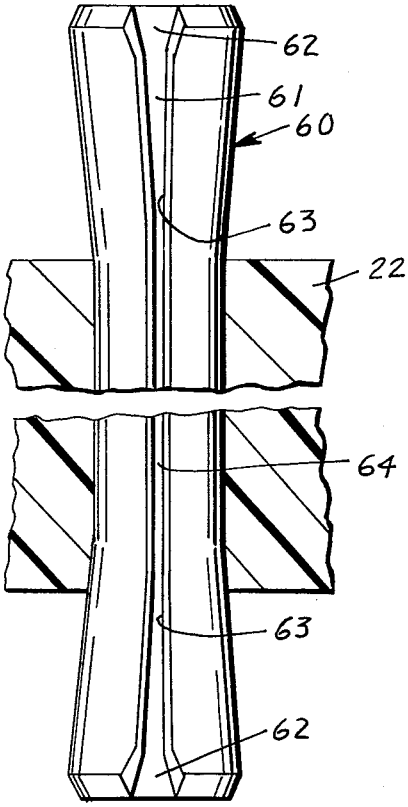
FIG. 14 is a side elevational view of another alternative embodiment.

While the contact element 20 thus far has been described in terms of unilateral entry into a conductor-retention slot, the invention is not so limited. Depending on the total connector arrangement in which the contact element 20 is used, it may become important to the system to provide the capability of bilateral entry. For those situations, a tubular member 60 is provided with a conductor-receiving slot 61 having an entry portion 62 at each end of the tubular member (see FIG. 14). Because of the substantially rigid character of the tubular member 60, the walls of the slot are substantially stationary as conductors 21—21 are moved into either or both ends. As can be seen in FIG. 14, a portion 64 of the slot 61 within the terminal block 22 is generally non-tapered and is connected to each entry portion 62 through a tapered portion 63.

Figure 16:
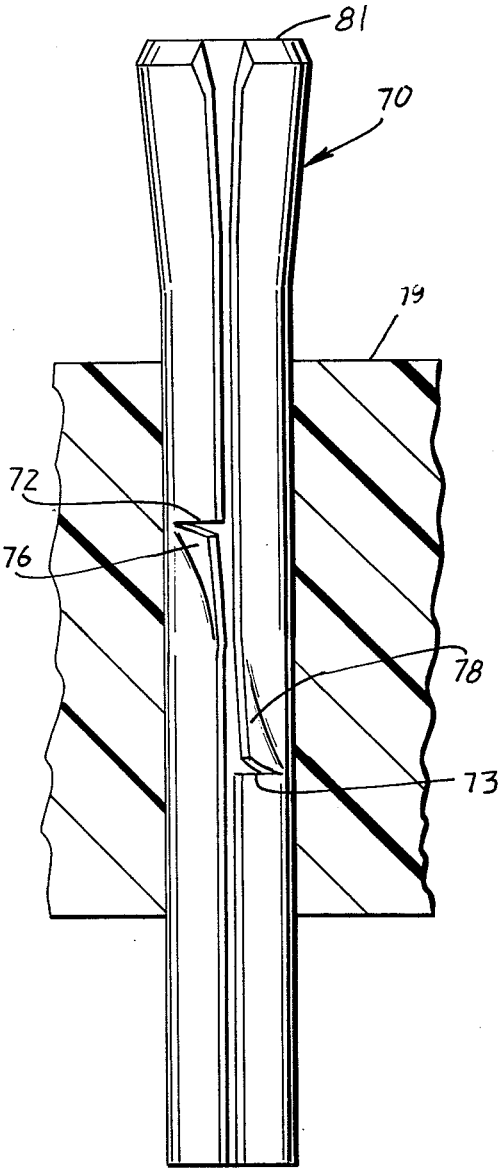
FIGS. 15–16 are views of a contact element of this invention which includes provisions for anchoring the contact element in a dielectric block.
Figure 15:
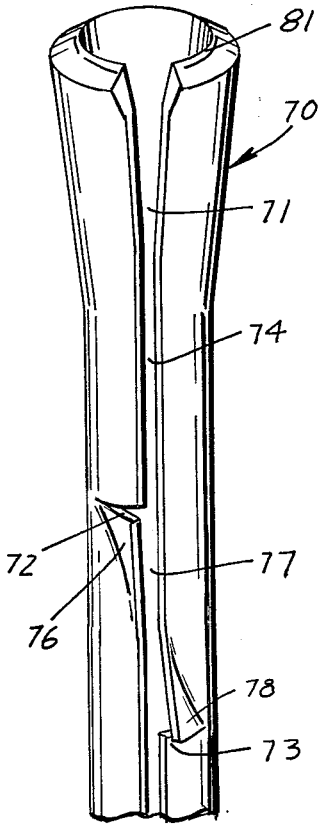

Of further interest is the contact element 70 which is shown in FIGS. 15–16. After a slot 71 has been formed longitudinally in its wall, two spaced slots 72 and 73 are cut transverse of the longitudinal slot. Because of the manner in which they are formed, one wall 74 which defines the slot 71 forms a barb 76 extending outwardly adjacent to the transverse slot 72 while the other wall 77 which defines the longitudinal slot forms a barb 78 extending outwardly adjacent to the transverse slot 73.

This barbed tubular member 71 is advantageous with respect to its seating in a dielectric housing 79 (see FIG. 16). As can be imagined, one or more contact elements may be inserted into openings which are formed in a plastic housing with the openings having a diameter slightly less than that of the tubular member. When a tubular member 71 is inserted into one of these openings, its seating with the housing is enhanced because of the barbs. If the contact element 71 is inserted, the barb 78 is caused to cut a channel along the plastic up to the point where movement is discontinued. On the other hand, the barb 76 is merely dragged along because of its taper from the slot 73 to the slot 72. If forces are applied to an end 81 of the tubular member 71, the barb 78 resists movement while forces applied to the other end are resisted by the engagement of the barb 76 with the plastic material.

Figure 17:
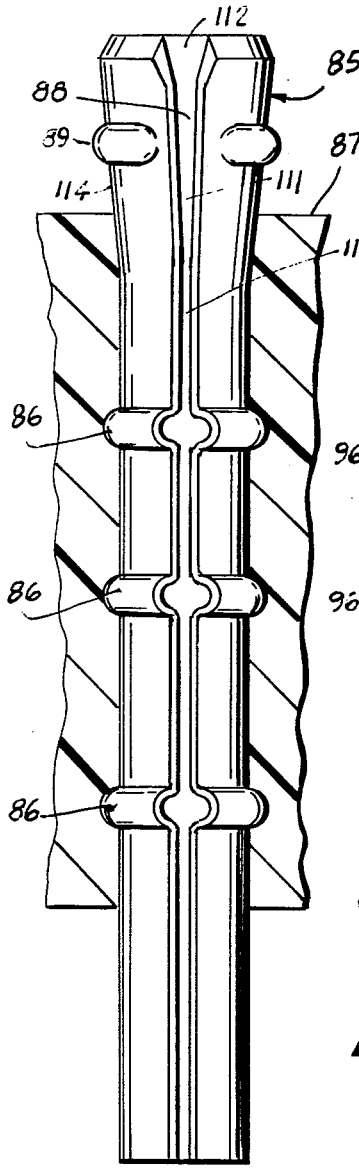
FIGS. 17, 17A and 18 are views of another contact element of this invention with alternate provisions for anchoring to a terminal block.

While the contact element 20 of this invention has been shown to be a tubular member which relies on its stiffness modulus for its rigidity, there are other arrangements which accomplish the same end. For example, as is shown in FIG. 17, a tubular member 85 may be provided with circumferentially disposed ribs 86—86 which are spaced along its outer surface. These ribs may be of a size and number as determined by a particular application. Advantageously, these ribs 86—86 not only provide the contact element 20 with additional stiffness, but they also anchor the tubular member 85 within a dielectric block 87. One or more ribs may also be formed on the tubular member 85 external to the block 87. Also, it is to be observed from FIG. 17 that the ribs need not extend to a conductor-receiving slot 88. This alternative is shown by the rib 89 in FIG. 17.

Figure 17A:
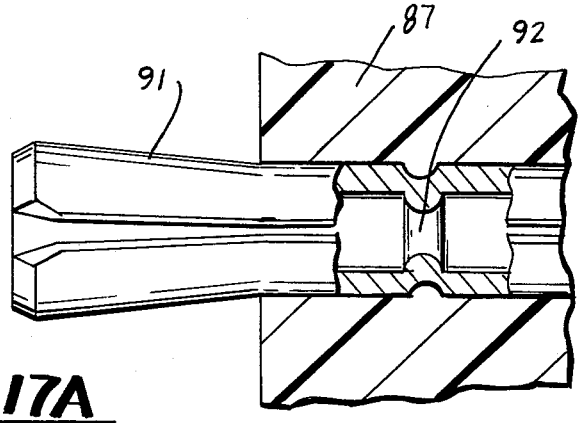

The use of the ribs 86—86 need not be confined to the external surface of the tubular member. As is shown in FIG. 17A, a tubular member 91 may include ribs 92—92 which are disposed on an inner surface of the tubular member as well as on an outer surface or on either surface alone.

Figure 18:
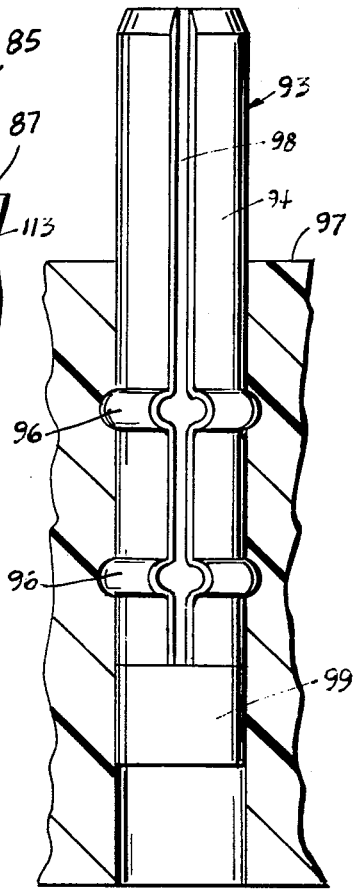

Of course, a contact element 93 may include a tubular portion 91 (see FIG. 18) formed to include ribs 96—96 only along that portion of the contact element which is disposed within a dielectric mounting block 97. These ribs 96—96 could extend to or be spaced from a slot 98. FIG. 18 is also illustrative of a contact element of which only a portion 94 is tubular with the slot 98 formed therein. Another portion 99 may be tubular without a slot or may be a rod.

Figure 19:
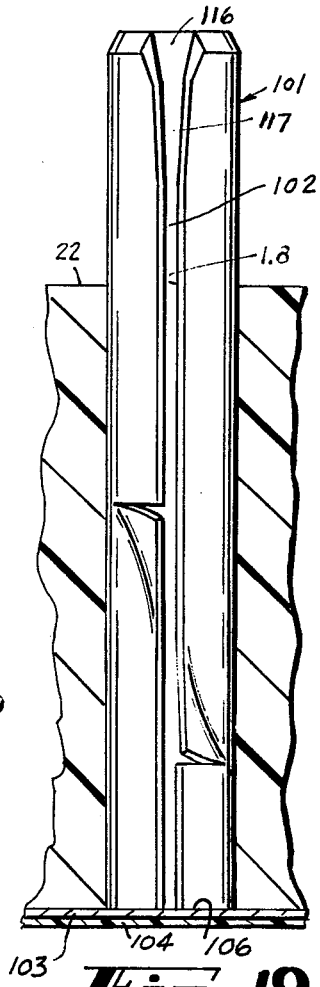
FIG. 19 is a side elevational view of a contact element of this invention which is used to connect two conductive elements.

Although the contact element 20 of this invention has been described thus far as being one for establishing an electrical connection between the conductive elements 23—23 of two or more insulated conductors 21—21, the invention is not so limited. A tubular member 101 having a slot 102 may be used to interconnect a wire-like insulated conductor 21 to a conductive element 103 such as one on a printed circuit board 104 (see FIG. 19). As is seen in FIG. 19, the contact element 20 extends to a lower surface 106 of the dielectric block 22 where it engages the conductive element 103 that is supported thereon. When an insulated conductor 21 is moved into the slot of the tubular member 101, its conductive element becomes connected electrically to the circuit pattern in the dielectric block. It should be apparent that although the contact element of this invention is most useful in terminating insulated conductors, it could just as well be used to do the same for wire-like, uninsulated conductive elements or for any combinations of those conductive elements that have been mentioned.

FIGS. 17, 18 and 19 are also illustrative of the combinations of slot and tubular member configurations which may be used for the contact element 20 of this invention. In FIG. 17, the slot 88 has a tapered portion 111 which joins an entry portion 112 to a parallel-sided slot 113 and the tubular member 85 includes a flared portion 114. Going to FIG. 18, it is seen that the tubular member 93 is cylindrical throughout its length without a flared end and includes the parallel sided slot 98. Finally, in FIG. 19 it is seen that the tubular member 101 is cylindrical without a flared end portion but the conductor-receiving slot 102 has an entry portion 116, a tapered portion 117 and an inner parallel-sided portion 118. The tubular member 101 in FIG. 19 also includes the anchoring barbs which were first shown in FIGS. 15 and 16.

It is to be understood that the above-described arrangements are simply illustrative of the invention. Other arrangements may be devised by those skilled in the art which will embody the principles of the invention and fall within the spirit and scope thereof.

What is claimed is:

1. A contact element for establishing an electrical connection between conductive elements of at least two insulated conductors with the conductive elements each having a diameter that falls in a predetermined range, said contact element comprising an open-ended substantially linear tubular member which is made of an electrically conductive material having a relatively high modulus of elasticity, which has an inner diameter that is less than twice the outer diameter of the smallest insulated conductor to be connected by said contact element and an outer diameter, and which has a thickness that is less than the minimum diameter of conductive elements in the predetermined range and that is relatively large with respect to said inner diameter of said tubular member, said tubular member including surfaces that define a longitudinal slot which is formed through a wall thereof from one end of said tubular member to the other for receiving one or more of the insulated conductors, which is parallel to a longitudinal axis of said tubular member and which has a width that is less than the minimum diameter of the predetermined range, further said tubular member at one end including a peripheral edge having at least a portion thereof which is diametrically opposite to said slot provided with a cutting edge which serves conductors that are moved into said slot and that extend past said peripheral edge, and said slot being configured and said tubular member having sufficient stiffness to cause at least portions of said surfaces which define said slot to nick the conductive elements of insulated conductors that are moved into and along said slot with any accompanying deflection of said surfaces being substantially negligible.

2. The contact element of claim 1, wherein at least a portion of said tubular member is tapered and surfaces of said wall which define said slot are parallel.

3. The contact element of claim 1, wherein at least a portion of said tubular member and a portion of said slot are tapered.

4. The contact element of claim 1, wherein said tubular member has a constant outer diameter and the width of said slot is substantially constant.

5. The contact element of claim 1, wherein said tubular member has a constant outside diameter and at least a portion of said slot is tapered.

6. The contact element of claim 1, wherein at least one end of said tubular member is formed with an entrance for a conductor and said longitudinal slot is tapered along a portion of its length from said entrance to a centrally disposed portion of the slot which has a uniform width, and where the width of the slot decreases in a predetermined manner inwardly from the conductor-receiving entrance of said tubular member so that when a first conductor is inserted into said tapered portion of said slot, the surfaces which define said slot nick the conductive portion thereof and when a second conductor is moved into said tapered portion of said slot, said first conductor is moved farther into said slot with said surfaces farther nicking said conductive portion thereof without severing said first conductor.

7. The contact element of claim 1, wherein said surfaces which define said slot are parallel.

8. The contact element of claim 1, wherein said surfaces which define said slot are formed along radii of said tubular member to cause said surfaces to diverge outwardly such that said surfaces adjacent to an inwardly facing surface of said tubular member are spaced apart a distance which is less than that adjacent to an outwardly facing surface of the tubular member.

9. The contact element of claim 1, wherein said tubular member includes two spaced slots cut transversely thereof and intersecting said longitudinal slot with one of said slot surfaces of said tubular member between said transverse slots caused to project outwardly a distance which increases toward one end of said contact element, and the other of said surfaces to project outwardly a distance which increases toward an opposite end of said tubular member.

10. The contact element of claim 1, wherein said walls which define said longitudinally extending slot are non-symmetrically disposed with respect to a longitudinal axis of said tubular member to cause said walls to nick a conductor which is received in said slot at other than diametrically opposed points.

* * * * *